US006409415B1

(12) United States Patent
Toder

(10) Patent No.: US 6,409,415 B1
(45) Date of Patent: Jun. 25, 2002

(54) HANGER

(75) Inventor: Ellis I. Toder, Abington, PA (US)

(73) Assignee: In Pro Corporation, Muskego, WI (US)

( * ) Notice: Subject to any disclaimer, the term of this patent is extended or adjusted under 35 U.S.C. 154(b) by 0 days.

(21) Appl. No.: 08/725,411

(22) Filed: Oct. 3, 1996

(51) Int. Cl.[7] ..... B42F 13/00; F16B 1/00

(52) U.S. Cl. ..... 403/397; 248/343; 52/39

(58) Field of Search ..... 403/397, 350, 403/348; 248/343, 317, 340, 228.1–228.7; 160/330, 350; 52/39, 506.07, 718.04, 714, DIG. 8; 24/716, 563, 545, 597, 682.1; 411/555

(56) References Cited

U.S. PATENT DOCUMENTS 3,003,735 A * 10/1961 Havener ..... 248/228.7
3,018,080 A * 1/1962 Loudon ..... 248/228.4
3,589,660 A * 6/1971 Dunckel ..... 248/343
4,065,090 A * 12/1977 Mauney ..... 248/317 X
4,191,352 A * 3/1980 Schuplin ..... 248/317
4,221,355 A * 9/1980 Hoop ..... 248/340
4,323,215 A * 4/1982 Berger ..... 248/228.1 X
4,564,165 A * 1/1986 Grant et al. ..... 248/317 X
4,908,915 A * 3/1990 Ruggles et al. ..... 24/336
5,335,890 A * 8/1994 Pryor et al. ..... 248/343
5,368,265 A * 11/1994 Gueli ..... 248/317 X
5,480,116 A * 1/1996 Callas ..... 248/228.4
5,490,651 A * 2/1996 Kump ..... 248/222.12
5,609,007 A * 3/1997 Eichner ..... 52/747.1

* cited by examiner

*Primary Examiner*—Lynne H. Browne
*Assistant Examiner*—John R. Cottingham
(74) *Attorney, Agent, or Firm*—Boyle Fredrickson Newholm Stein & Gratz S.C.

(57) ABSTRACT

A clip is adapted to connect a ceiling grid strip or the like with a curtain track or the like. The clip is capable of selective rotation with respect to the grid strip of 90°, without becoming disengaged from the grid strip. The grid strip is generally rectangular and has a pair of diagonally opposed upper grip portions each being provided with inwardly facing slots and each being affixed to the top of the clip at the extreme corners. A pair of oppositely disposed lower grip portions are provided on the lower side of the clip to retain a track. In one variation of the invention, the lower grip portions are provided on a separate piece which is attached to the clip top with a swivel post so that there is a more extensive and more reliable means for changing orientation. In another variation, the clip top has a downwardly depending extension and means to retain some other element are provided at the bottom of the extension. Such means may be a flange.

10 Claims, 5 Drawing Sheets

HANGER

BACKGROUND OF THE INVENTION

1. Field of the Invention

This invention relates generally to the hardware equipment for use with traveling cubicle curtains, primarily or generally available in hospitals to establish privacy around the bed of a patient. Typically, fabric curtains are mounted with hangers and tracks and other fastening means in such a way that they can be pulled around the patient's bed to shield the patient from vision, or alternatively, may be withdrawn. Typically, the fabric curtain folds into accordion-like pleats as it is withdrawn. It is not limited to curtains.

It is an important aspect and object of this invention to provide a clip suitable for connecting a portion of the fixed ceiling in the room to a track means which in turn typically carries moveable trolleys or hangers. The term "hanger" used herein is meant to refer generally to any part of the involved hardware. More specifically, the particular element of hardware to which this invention is directed may better be described as a "clip".

2. Prior Art

It is well known to provide hangers, tracks, and the like in the environment of hospital bed curtains. In fact, the application of the withdrawable curtain hung from ceiling fixtures is only typical or generally associated with hospital beds. Known prior art patents dealing generally with this subject include U.S. Pat. Nos. 4,599,763; 293,339; 1,267,279; and 2,804,326. None of these earlier presently known patents anticipate or suggest the present invention.

SUMMARY OF THE INVENTION

This invention relates most usually to the provision of flexible fabric curtains which are intended to be extended typically around the hospital bed and alternatively to be withdrawn. Generally, such curtains are suspended from tracks which are affixed to the ceiling, and the hardware elements that hold the curtains are free to move in the tracks. The invention has broader applicability.

It is important, particularly in the environment of hospital and nursing home management, that a high degree of economy and flexibility be provided. The present invention specifically relates to a clip which connects a curtain track to a ceiling fixture. Generally, in the contemplation of this invention, the ceiling fixture is a T bar with a generally flat flange part accessible from below. Such T bars are very often used in maintaining the ceiling panels in institutional and other room environments.

This invention is applicable to both flush ceiling tiles and to tegular edge ceiling tiles.

Use of the clips of the present invention has a number of advantages. Their use permits the track to be installed either parallel to and aligned with a longitudinal direction of a ceiling T bar, or alternatively, at right angles to the longitudinal dimension of such a T bar, or indeed, at any desired angle to the longitudinal dimension of the T bar.

The clips, which support the tracks, which in turn support the hangers or other devices to hold up the curtain or other devices, are directly attached to the T Bar Flange, and therefore, a change in the orientation of the clip with respect to the longitudinal dimension of the T bar provides for flexible and easily user-adjustable selective orientation of the track, and hence of the curtain orientation, with respect to the longitudinal dimension of a ceiling grid T bar.

Furthermore, this selection or adjustment may be made without the use of screws, or other fasteners, or the use of tools. It may be made by simple manual adjustment.

The invention permits easy installation and removal of tracks without damage to the ceiling. The clips grip the T bar system with a simple insertion, and may be adjusted with a simple twist. A particularly important aspect of the invention is that the clip is a single simple one piece integrally molded plastic element. It is provided with tabs that fit over the top of the opposed flanges of the bottom accessible portion of the T bar. The flanges are diagonally opposed and they permit the clip to be rotated with respect to the longitudinal dimension of the T bar without becoming detached from it. The structure permits a 90° angle of twist. The clip may be easily inserted onto the T bar. The track may be easily inserted into the clip.

DESCRIPTION OF THE PREFERRED EMBODIMENTS

Figure 1:
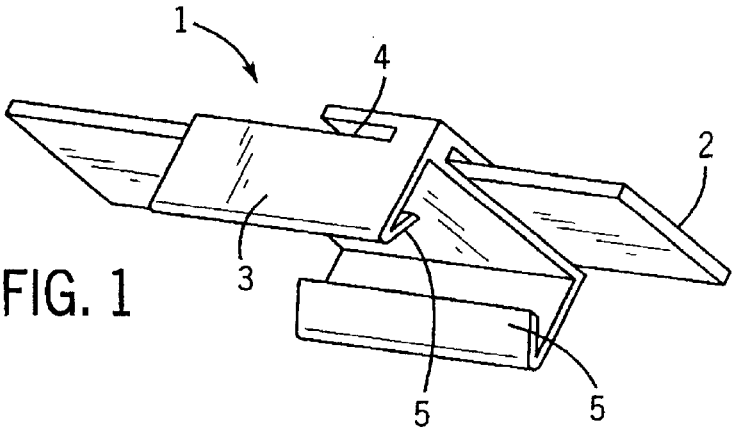
FIG. 1 is a perspective view, taken from the lower right corner showing the clip mounted on the ceiling fixture flange, aligned with the longitudinal direction of the flange.
Figure 2:
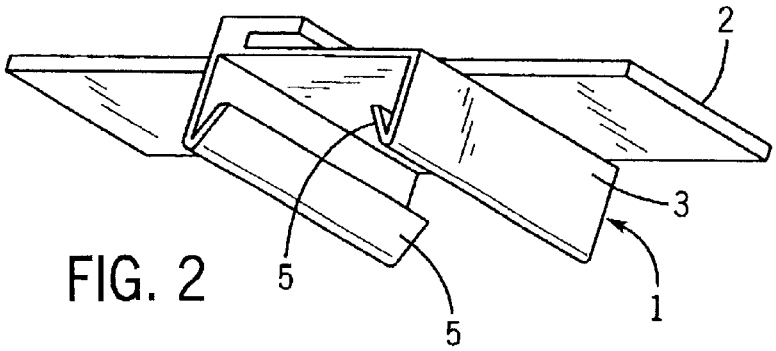
FIG. 2 is a perspective view, taken from the lower right corner showing the clip mounted on the ceiling fixture flange, aligned at right angles to the longitudinal direction of the flange.
Figure 3:
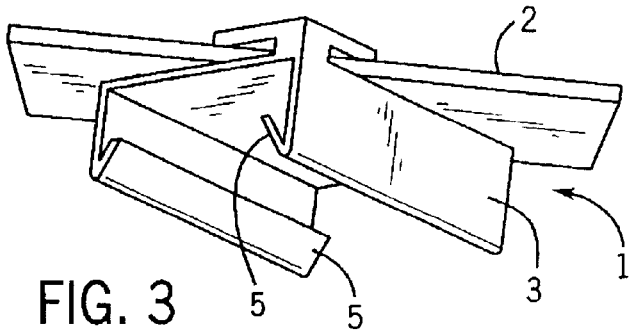
FIG. 3 is a perspective view, taken from the lower right corner showing the clip mounted on the ceiling fixture flange, aligned at an angle with respect to the longitudinal dimension of the flange.

FIGS. 1, 2 and 3 illustrate the clip in three different possible positions. In each figure, the clip is generally designated 1. The grid strip 2, which may be also be called a flange, or a T bar head, or a horizontal strip, is a fragmented showing of part of the fixed ceiling structure. Such grid strips are very common in many ceiling constructions, particularly in institutions. The flat horizontal metal pieces or flanges are generally arranged in rectangular grids. Ceiling tiles are disposed between the intersecting grids and are retained by resting on the grids.

In each of FIGS. 1, 2, and 3, the clip, generally designated 1 is shown as having a side 3, an upper grip portion 4 and a lower grip portion 5.

In FIG. 1, the clip 1 is shown aligned with the longitudinal dimension of grid strip 2. That is, the lower grip portions 5 of clip 1 extend in the same direction as the grid clip 2, and thus any object, such as a curtain, attached through other intermediary means to the lower grip portion will hang or be otherwise disposed in the same direction as the grid strip 2.

In FIG. 2, the clip 1 is shown so positioned that its sides 3 and lower grip portions 5 are at right angles or 90° to the longitudinal dimension of the grid strip 2. It is an important part of this invention that the structure of the clip on permits the change of orientation of the clip with respect to the grid strip by a simple manual rotational movement. There is no necessity to use a tool or release a screw or other mechanical means. Very importantly, this rotation and re-positioning can be made without removing the clip from the grid strip.

In FIG. 3, the orientation of the clip on is shown at a position intermediate between aligned with the grid strip 2 (0°), and at right angles to the grid strip 2 (90°). While the clip 1 remains attached in this intermediate position, it has been found that the reliability of the attachment under a vertical load is substantially decreased, and while it is theoretically possible to obtain an intermediate positioning in this manner, for the purpose of reliability and security of attachment, it has been found not preferable and not recommended to do so. Nevertheless, the fact that the clip remains attached in the intermediate position means that it can be rotated from a set position of 0° to a set position of 90° without necessarily becoming detached. A stronger and more secure alternate embodiment to permit intermediate angle positioning is described below in connection with FIG. 9.

Figure 4:
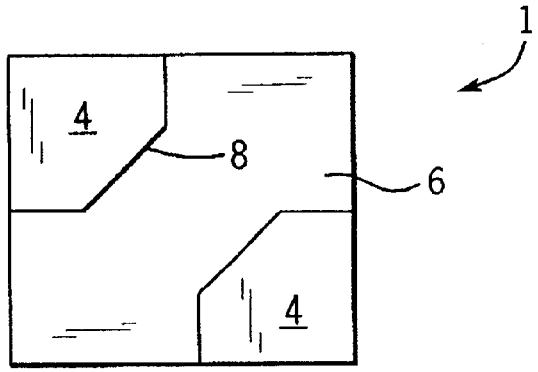
FIG. 4 is a plan view of the clip, viewed from above.
Figure 5:
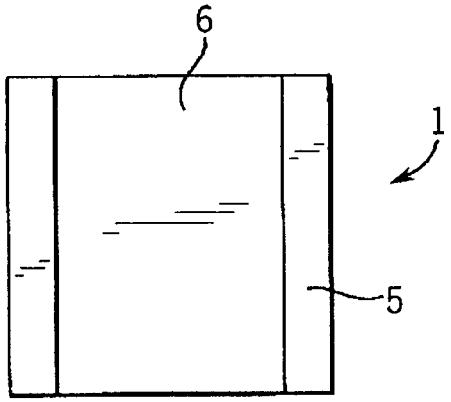
FIG. 5 is a plan view of the clip, viewed from below.
Figure 6:
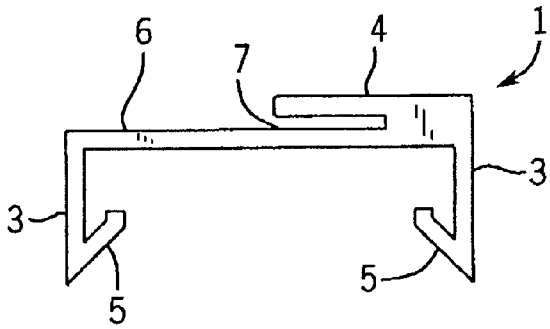
FIG. 6 is an elevation view of the end of the clip.
Figure 7:
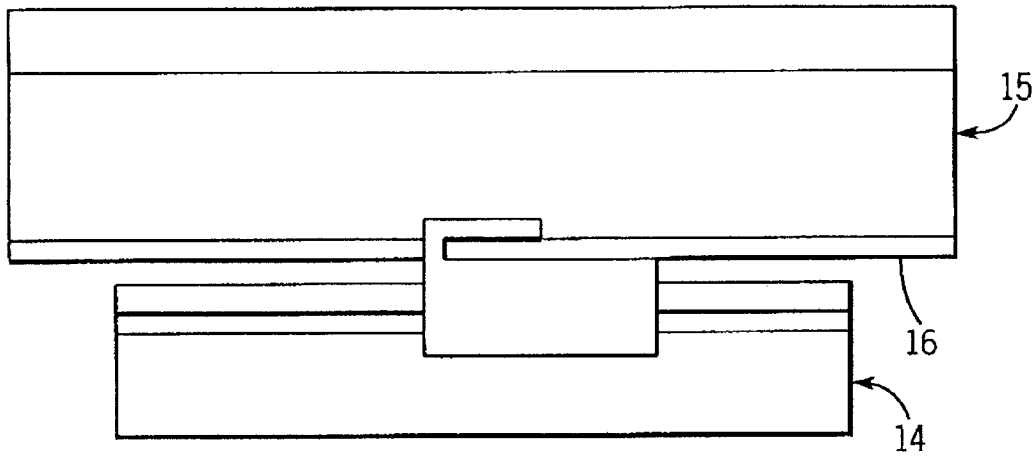
FIG. 7 is an elevation view of a T bar, a clip affixed to the T bar, a curtain track affixed to the clip, with the clip aligned with the longitudinal dimension of the T bar.
Figure 9:
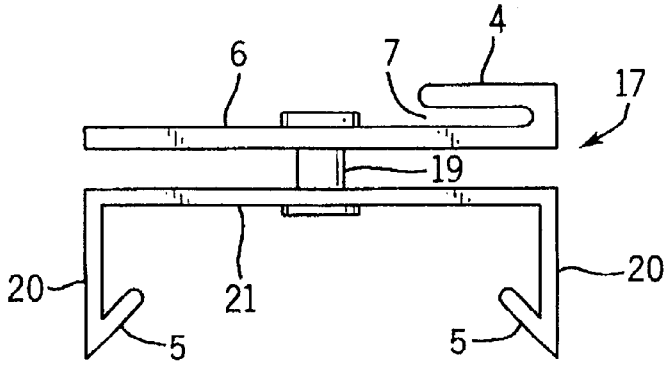
FIG. 9 is an elevation view of the end of an alternate embodiment of the clip, with structure providing for angular setting.
Figure 10:
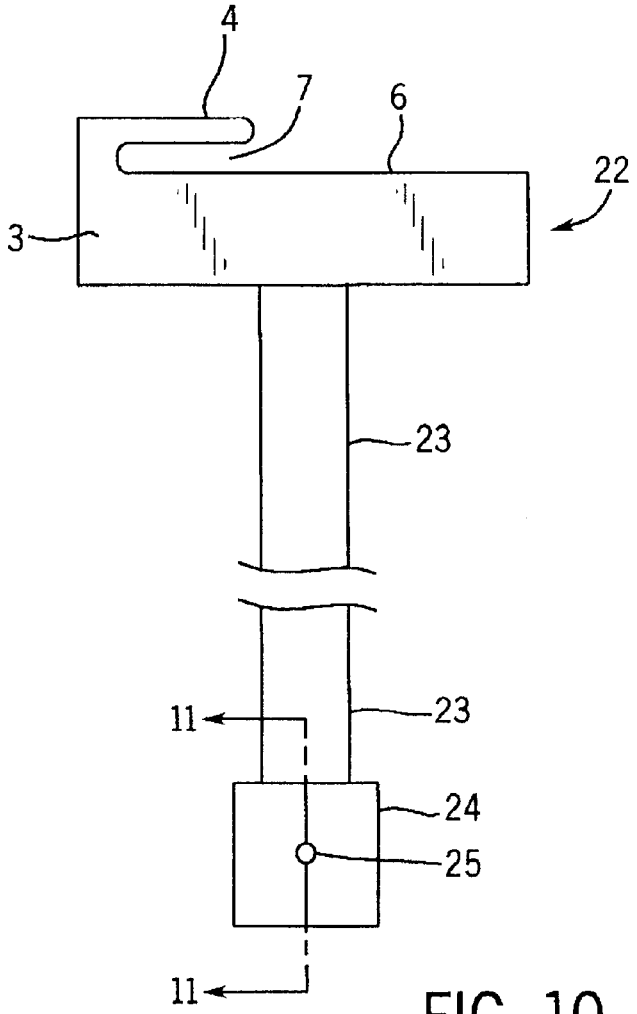
FIG. 10 is an elevation view of the end of the clip in an alternate embodiment, showing object attaching means displaced vertically downward.

The structure of the clip 1 is best shown in FIGS. 4, 5, and 6, and to some extent in FIG. 7. The clip 1 is the principal subject matter of this invention. Alternate embodiments of the clip, exemplified in the showings of FIGS. 9 and 10, are also subjects of this present invention.

In its preferred or standard embodiment, as best shown in FIGS. 4–7, the clip 1 is an integral molded piece of any conventional suitable plastic, such as polypropolene or Celcon or nylon by way of example only. FIG. 4 is a plan view of clip 1, viewed from above, as the clip is normally oriented in use. It preferably comprises a flat clip top 6, and is preferably square in shape in the FIG. 4 view. A typical preferred dimension along each edge of FIG. 4 is about 1 ⅜" (3.5 cm).

At each of two opposed corners of clip 1, an upper grip portion 4 is provided. The upper grip portions 4, are each integral with the clip top 6, and are attached at the very corners. Except for the attachment at the corners, the upper grip portions 4 are undercut. As best shown in FIG. 6, this undercut produces a slot 7.

FIG. 6 is an end view of the clip, and the extent of the corner integral attachment and the slot 7 are shown from an end view orientation.

FIG. 7 is an elevation view of a T bar, a clip affixed to the T bar, a curtain track affixed to the clip, with the clip aligned with the longitudinal dimension of the T bar. For the purpose of the present discussion, the point of interest in FIG. 7 is that in its showing of a side view of clip 1, the extent of the slot 7 and the very corner attachment are shown. It is apparent that from both an end view and a side view, each of the upper clip portions 4 are identical.

Referring again to FIG. 4, it is seen that the preferred plan structure of upper grip portion 4 is of a truncated square. Square truncation 8 shows how a corner of what would otherwise be a square has been cut off. The full edges of each upper grip portion 4 are typically about 9/16" (1.5 cm). The truncated or cut off edges of each of the upper grip portions 4 are each typically about ¼" (6 mm) long before the truncation starts. It is understood of course that the exact dimensions are given here to exemplify a preferred embodiment and to give a general sense of size and scale, but are not in themselves critical to the principle of the invention.

It is apparent that, with reference to FIG. 4 preferably, the flange or grid strip or head of the T bar can pass under each of the opposed upper grip portions 4, with the edges of the flange or strip running parallel to either set of opposed sides of the clip 1. For example, the width of the flange or the like may be on the order of 1" or 5/16". Its width and thickness are such that it can pass through the slots created by the upper grip portions 4. With reference to FIG. 4, to exemplify, the strip could run vertically with reference to the illustration, or horizontally. In each case, it would pass through a different part of the slot 7 or undercut of the upper grip portions 4. Furthermore, if the clip 1 orientation is rotated with respect to the longitudinal dimension of the grid strip or flange (not shown in FIG. 4) edges of the flange or grid strip also pass within the slots, and are retained there against separation, although not against rotational adjustment. The general relationship of a grid strip 2 to a clip 1 is shown in FIGS. 1, 2, and 3, in perspective. In FIG. 7, such a grid strip 2 is shown in an edge view, as part of a T bar.

FIG. 5 is a plan view of clip 1 viewed from below, as the clip is oriented in use. This figure illustrates a plan view of the pair of opposed lower grip portions 5, which extend from opposed edges of the clip 1. These lower grip portions 5 are molded integrally with the remainder of the clip.

As best shown in FIG. 6, in an end view of the clip 1, the lower grip portions 5 are inwardly folded extensions of sides 3, and they form V-shaped channels. In preferable practice, the thickness of the lower grip portions 5 is somewhat less than that of the sides 3, and the lower grip portions 5 have a degree of resilience.

Figure 8:
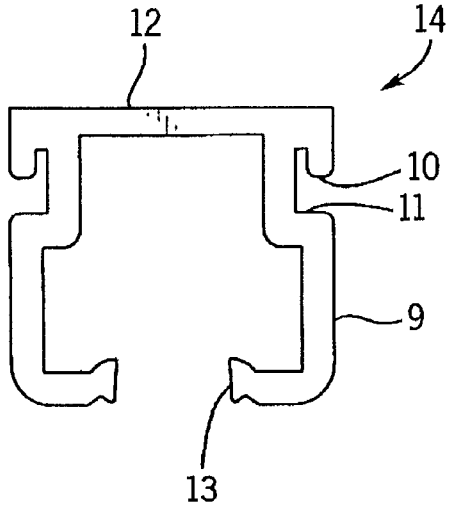
FIG. 8 is an elevational end view of the track.

The lower grip portions 5 comprise means to retain, support or hold another element. In the general and typical context, that other element is usually a track 14. The track 14 is best understood in connection with FIGS. 7 and 8, and is best initially described in connection with FIG. 8. FIG. 8 is an end view of a section of track. The track 14 is the support from which generally a curtain-carrying trolley or roller depends.

The track 14 generally comprises a track top 12, and an opposed pair of track sides 9. Each track side 9 has a longitudinally extended groove 11, partially defined by an ear 10. The track 14 and its ears 10 and grooves 11 are sized and configured so as to slide onto and over the lower grip portions 5 of the clip 1. The lower grip portions 5 hook into or extend into the grooves 11.

FIG. 7 shows such a track 14 as connected to a clip 1 in the manner described above. In FIG. 7, in addition the clip 1 is shown attached to the T bar generally designated 15 having a flange or strip 16. The manner in which the clip 1 is affixed to the strip 16 has been described above. The track 14 has at its lower end, a pair of inwardly and upwardly facing trolley supports 13. A trolley or roller or other structure, not in itself constituting part of this invention, is supported by the trolley support 13.

In general, the track 14 is connected to the clip 1 by being slid in from open ends of both elements. However, because of the resiliency of the lower grip portions 5, it is possible to in effect snap-in the track 14 by pressing it directly against the sides of the lower grip portion 5 and deflecting them toward the clip sides 3 sufficiently so that they may engage the track grooves 11.

It has been found that even though the clip may be positioned at an angle other than 0° or 90° to the grid strip or flange 2, as best shown in FIG. 3, the reliability against the downward pull is decreased, and the main purpose of this position is as a transitional position between 0° and 90°.

Therefore, FIG. 9 illustrates means which are more preferably adapted to support a track or other structure at an angle other than 0° or 90° to the longitudinal dimension of a grid strip 2.

FIG. 9 shows an alternate construction of the clip of the present invention. The embodiment of FIG. 9 is intended to provide a clip or clip assembly with more reliable support for tracks or other elements which are to be supported at other than angles 0° or 90° with respect to the longitudinal dimension of a grid strip or flange. The clip with swivel, generally designated 17, has a conventional clip top 6 and upper grip portion 4, with slot 7.

It is noted that in connection with both FIG. 6 and FIG. 9, only the front or closest upper grip portion 4 is illustrated. The rear such upper grip portion 4 would be visible at the left side of the drawing, but is omitted to make the showing of the structure clearer.

In FIG. 9, the lower grip portions 5 are mounted on an independent lower grip portion structure generally designated 18.

This independent lower grip portion structure has sides 20 and a top 21. It is connected to the clip with swivel 17 by means of a swivel post 19. Typically and preferably, the swivel post 19 is an integral portion of the independent upper grip portion structure 18. The clip top 6 is provided preferably with a keyhole-like opening on its lower side to receive the expanded head of the swivel post 19. Thus, a swiveling connection is provided. The structural details of the head of the swivel post and the hole in the clip top are not illustrated in detail since they are conventional and their exact structure is not critical to the present invention.

FIG. 10 shows yet another alternate embodiment of the invention. In this embodiment, the purpose is to make provision for applications in which it is desired that element or article to be suspended should be displaced further from the ceiling than is normally permissible. It also has the purpose of providing means to suspend elements or articles other than a curtain or a trolley for a curtain.

In FIG. 10, a clip with extension, generally designated 22 has the upper grip portions 4 defining the slot 7, and the clip top 6. However, instead of the lower grip portions as has been described in connection with the embodiments, there is an depending extension 23. This may be a simple bar or column. At the lower end of the extension 23 there is a socket 24. The socket may typically have a hole to receive a fastening pin or other device 25. A structure such as set forth in FIGS. 10 and 11 permits the support of devices such as a track, as used in a hospital environment. Such devices can be attached to the flange 24 or to similar or equivalent or other conventional attaching means at the bottom of the depending extension 23.

The invention may my be broadly described as follows. A clip is adapted to connect a ceiling grid strip or the like with a suspended track or the like, with mutual orientation of said clip and said ceiling grid strip or the like that may be selectively chosen without disengagement. The clip comprises a rectangular clip top having edges, a pair of upper grip portions diagonally oppositely positioned at corners of said clip top, each of said upper grip portions integral with said clip top at the very corners of said clip top, and said upper grip portions having inwardly facing slots. The clearance through said slots is sufficient to permit the passage and retention of said grid strip or the like in any orientation within 90° between one pair of edges of the clip top and a perpendicular pair of edges of the clip top. Each of the upper grip portions are truncated rectangles with truncated sections facing inwardly.

In one embodiment, the clip top has edges of equal length; that is, the clip is square in its horizontal view. The clip top, on its surface opposite to the surface with the upper grip portions, is provided with a pair of lower grip portions. The lower grip portions are disposed along a pair of opposing said edges of the clip. The clip has a pair of opposed sides downwardly depending from said clip top and said lower grip portions are integral with the bottom edges of the sides. In the preferred embodiment, the upper grip portions, clip top, sides, and lower grip portions are all of a single integral molded plastic.

In a variation, the clip has an independent lower grip portion structure having a pair of opposed downwardly depending sides, and a lower grip portion on each of the sides, with the independent lower grip portion structure having a top provided with a upwardly extending swivel post. The clip top is provided with an aperture to receive said swivel post and retain it, whereby said lower grip portions may be rotated with respect to the clip top.

Figure 11:
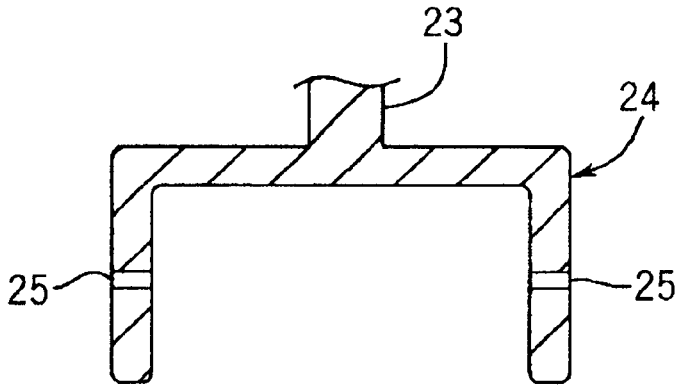
FIG. 11 is a fragmented cross-sectional view taken along line 11—11 in FIG. 10.
Figure 12:
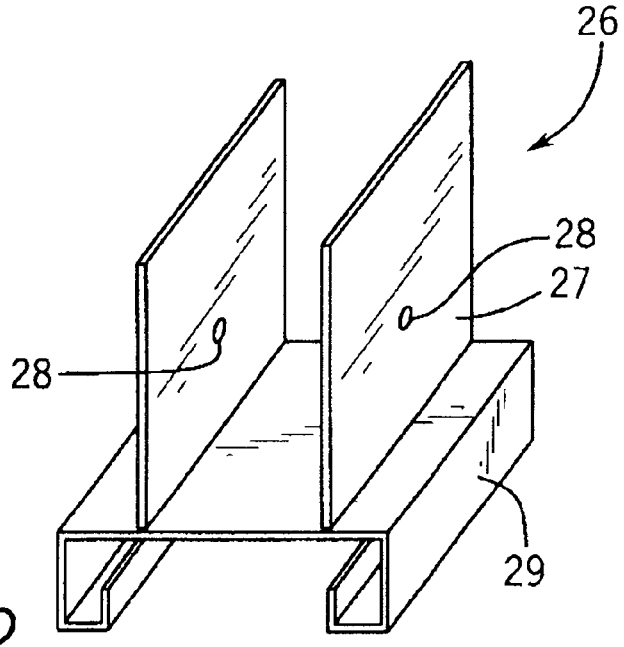
FIG. 12 is a perspective view of a track element.

In another variation, the clip has a depending extension is provided downwardly from the clip top, and means to retain an element are provided at the lower end of the extension. The retaining means to retain said element, which may be a track, may comprise a flange which may be provided with element retention means. FIG. 11, which is a fragmented cross-sectional view at the bottom part of the extension shown in FIG. 10, best shows flange or fork 24. This flange 24 is provided with a pair of holes 25 through each side to receive a retaining pin, not shown. In FIG. 12, a track element, generally designated 26, is shown in fragmented form with its attaching means. Track element 26 has upstanding track flanges 28, each provided with holes 27. The track flanges 28 and its holes 27 are sized and configured to coact and fit with the depending element flange or fork 24 with its holes 25, secured thereto with a pin through all the holes. The track 29 is thus suspended by means of its flanges 27 to the hanger.

The exact dimensions and exact materials of the devices discussed herein are not in themselves critical, although the interfacing relationships are of course important. Conventional materials may be used. Except for the grid strips or flanges, which are typically metal, the other parts are typically known, conventional and suitable plastic materials.

I claim:

1. A clip adapted to connect a strip with a track, with mutual orientation of said clip and said strip that may be selectively chosen without disengagement, said clip comprising a rectangular clip top having edges, a pair of upper grip portions diagonally oppositely positioned at corners of said clip top, each of said upper grip portions integral with said clip top at the corners of said clip top, and each of said upper grip portions defining a diagonal slot at each corner of said clip top between said upper grip portion and said clip top, each slot facing directly toward the slot on the opposite corner.

2. A clip as set forth in claim 1 wherein a clearance through said slots is sufficient to permit the passage and retention of said strip in any orientation within 90° between one pair of said edges of said clip top and a perpendicular pair of said edges of said clip top.

3. A clip as set forth in claim 2 wherein each of said upper grip portions are truncated rectangles with truncated sections facing inwardly.

4. A clip as set forth in claim 3 wherein said clip top has said edges of equal length.

5. A clip as set forth in claim 1 wherein said clip top, on its surface opposite to the surface with said upper grip portions, is provided with a pair of lower grip portions.

6. A clip as set forth in claim 5 wherein said lower grip portions are disposed along a pair of opposing said edges of said clip.

7. A clip as set forth in claim 6 wherein said clip has a pair of opposed members downwardly depending from said clip top and said lower grip portions are integral with the bottom edges of said members.

8. A clip as set forth in claim 7 wherein said upper grip portions, said clip top, said members, and said lower grip portions are all of a single integral molded plastic.

9. The clip as set forth in claim 1, wherein except for the corners of said clip top that are integral with said upper grip portions, said upper grip portions are undercut to form said slots and enable said clip to maintain engagement with the strip over a 90° rotational angle of orientation between said clip and the strip.

10. The clip as set forth in claim 6, said lower grip portions including inwardly folded extensions arranged to form V-shaped channels between said extensions and their respective member.

* * * * *